US011462889B2

(12) United States Patent
Fuchs et al.

(10) Patent No.: US 11,462,889 B2
(45) Date of Patent: Oct. 4, 2022

(54) APPARATUS FOR IGNITING A FUEL MIXTURE, TRANSMISSION ELEMENT FOR TRANSMITTING AN IGNITION SIGNAL, IGNITION DEVICE AND CIRCUIT DEVICE

(71) Applicant: Rosenberger Hochfrequenztechnik GmbH & Co. KG, Fridolfing (DE)

(72) Inventors: Martin Fuchs, Freilassing (DE); Gunnar Armbrecht, Tittmoning (DE); Willem Blakborn, Inzell (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 82 days.

(21) Appl. No.: 17/263,296

(22) PCT Filed: Jul. 26, 2019

(86) PCT No.: PCT/EP2019/070268
§ 371 (c)(1),
(2) Date: Jan. 26, 2021

(87) PCT Pub. No.: WO2020/021106
PCT Pub. Date: Jan. 30, 2020

(65) Prior Publication Data

US 2021/0218232 A1 Jul. 15, 2021

(30) Foreign Application Priority Data

Jul. 27, 2018 (DE) ..... 10 2018 118 263.5

(51) Int. Cl.
*H01T 13/05* (2006.01)

(52) U.S. Cl.
CPC ..... *H01T 13/05* (2013.01)

(58) Field of Classification Search
CPC ..... H01T 13/05
(Continued)

(56) References Cited

U.S. PATENT DOCUMENTS 5,558,794 A 9/1996 Jansens
5,603,306 A 2/1997 Tai
(Continued)

FOREIGN PATENT DOCUMENTS

DE 3902029 A1 7/1990
EP 0273413 A2 7/1988
JP H0721834 A 1/1995

OTHER PUBLICATIONS

Jost K: "The Continuing Evolution of the Spark Plug", Automotive Engineering Society of Automotive Engineers. Warrendale, US, vol. 104, No. 2, Feb. 1, 1996, pp. 72-77, ISSN: 0098-2571.
(Continued)

*Primary Examiner* — Christopher M Raabe
(74) *Attorney, Agent, or Firm* — Randall Danskin P.S.

(57) ABSTRACT

The invention relates to an apparatus for igniting a fuel mixture. Set apparatus comprises an ignition system for generating a high-voltage ignition voltage as well as a circuit device comprising a circuit for superimposing a high-frequency signal on to the high-voltage ignition voltage. The apparatus further comprises a spark plug in an engine block as well as a transmission element for transmitting the ignition voltage, onto which the high-frequency signal has been superimposed, to the spark plug. The transmission element includes a contact element which is provided with an electrically conductive coating along at least one portion of the longitudinal axis of the contact element, the impedance of the coding being lower than the impedance of the contact element.

37 Claims, 2 Drawing Sheets

(58) Field of Classification Search
USPC ..... 315/62
See application file for complete search history.

(56) References Cited

U.S. PATENT DOCUMENTS

| | | | | |
|---|---|---|---|---|
| 6,850,069 | B2 | 2/2005 | McQueeney | |
| 8,550,048 | B2 | 10/2013 | Stifel | |
| 9,435,314 | B2 | 9/2016 | Silva | |
| 9,617,966 | B2 | 4/2017 | Armbrecht | |
| 2004/0079139 | A1 | 4/2004 | Hiramatsu | |
| 2016/0036203 | A1* | 2/2016 | Tamas ..... | H04B 15/02 361/253 |
| 2020/0023555 | A1 | 1/2020 | Vidalat | |

OTHER PUBLICATIONS

German Search Report dated May 6, 2019.
International Search Report dated Oct. 16, 2019.
Miscellaneous PCT Documents PCT/EP2019/070268.
Office Action issued by the State Intellectual Property Office of China dated Oct. 22, 2021.

* cited by examiner

APPARATUS FOR IGNITING A FUEL MIXTURE, TRANSMISSION ELEMENT FOR TRANSMITTING AN IGNITION SIGNAL, IGNITION DEVICE AND CIRCUIT DEVICE

RELATED APPLICATIONS

This US National Phase patent application claims priority to German Patent Application No. 10 2018 118 263.5 which was filed on 27 Jul. 2018, and also claims priority to PCT/EP2019/070268 which was filed on 26 Jul. 2019 and which was published as WO 2020/201106 A1 on 30 Jan. 2020. The entire contents of each of the aforementioned Patent Applications is expressly and fully incorporated herein by this reference. This claim of priority is also being made in, and is set forth in, the Application Data Sheet (ADS) filed contemporaneously herewith.

BACKGROUND

The invention relates to an apparatus for igniting a fuel mixture, in particular a fuel-air mixture, with an ignition system for generating a high ignition voltage and with a spark plug arranged in an engine block and a transmission element for transmitting the ignition voltage to the spark plug.

The invention further relates to an apparatus for igniting a fuel mixture, in particular a fuel-air mixture, with an ignition system for generating a high ignition voltage and with a spark plug arranged in an engine block and a transmission element for transmitting the ignition voltage to the spark plug.

The invention also relates to a transmission element for transmitting an ignition signal from an ignition system to a spark plug, having a contact element.

The invention further also relates to an ignition device for generating an ignition signal. The invention even still further relates to a circuit device.

Apparatuses for igniting a fuel mixture, in particular a fuel-air mixture, are known in various designs from the prior art. The aim of the current invention is to further improve the combustion process in the combustion chamber of an engine, in particular an internal combustion engine with spark ignition by spark plugs, also known as a gasoline engine.

The fuel-air mixture introduced into the combustion chamber or a cylinder is usually compressed by a piston moving in the combustion chamber. Shortly before top dead center is reached, a spark from a spark plug ignites the fuel-air mixture.

It is known from the prior art that an ignition system or an ignition coil transforms a battery voltage of a vehicle to a desired ignition voltage in order to provide an ignition signal or an ignition voltage, in particular a high ignition voltage. The ignition voltage is then applied to the spark plug or the ignition signal is transmitted to the spark plug via a transmission element, which can have a suitable contact element for this purpose. The contact element is usually embodied as an ignition line, in particular as a high-voltage conductor.

Spark plugs of different designs are known from the general prior art. The ignition voltage is usually applied via a connecting bolt, which is insulated from the outside, for example by means of a plug insulator, in order to provide the ignition voltage at a so-called center electrode. The ignition spark then jumps from the center electrode to a ground electrode and in doing so overcomes the spark gap or the distance between the two electrodes. The ground electrode is usually electrically conductive, and usually connected to the engine block or the cylinder head via a thread.

The contact element, for example the high-voltage conductor, which transmits the high ignition voltage from the ignition system to the spark plug, is mostly guided by an insulation element that encompasses or surrounds the high-voltage conductor on the outside of the high voltage conductor.

It is also known from the prior art to use a high-frequency plasma ignition apparatus as an alternative to generating a high ignition voltage for the purpose of igniting a fuel-air mixture.

Reference is made to DE 20 2012 004 602 U1, for example, which describes a high-frequency plasma ignition apparatus for an internal combustion engine, in particular for igniting a fuel-air mixture in a combustion chamber of an internal combustion engine using a series resonant circuit.

The automotive industry and its suppliers and research institutes are working intensively on further improving the combustion process, especially in gasoline engines.

The present invention is based on the object of further improving a device for igniting a fuel mixture with an ignition system for generating a high ignition voltage and a spark plug arranged in an engine block in order to further optimize the combustion process, in particular in a gasoline engine.

The present invention is also based on the object of providing an improved transmission element for transmitting an ignition signal from an ignition system to a spark plug.

The present invention is also based on the object of providing an ignition device for generating an ignition signal in order to further improve the ignition of a fuel mixture in a combustion chamber of an internal combustion engine in order to further optimize the combustion process, in particular in a gasoline engine.

Furthermore, the present invention is based on the object of providing a circuit device which makes it possible to further improve the ignition of a fuel mixture in a combustion chamber of an internal combustion engine in order to further optimize the combustion process, in particular in a gasoline engine.

According to the invention, the apparatus for igniting a fuel mixture, in particular a fuel-air mixture, has an ignition system for generating a high ignition voltage and a circuit device comprising a circuit for superimposing a high-frequency signal on the high ignition voltage. The apparatus further comprises a spark plug arranged in an engine block and a transmission element for transmitting the high ignition voltage on which the high-frequency signal is superimposed to the spark plug.

The spark plug is preferably located in a shaft within the metal engine block.

Of course, the apparatus can optionally also have several spark plugs and correspondingly a plurality of transmission elements.

In the apparatus according to the invention, a high-frequency signal is superimposed on the high ignition voltage generated by the ignition system.

The high-frequency signal can be generated by a high-frequency generator. High-frequency generators for generating a high-frequency signal are basically known from the prior art.

Within the scope of the invention, the high-frequency signal can be generated by the circuit device, but can also be generated externally, and transmitted to the circuit device, in particular to the circuit of the circuit device.

The fact that a high-frequency signal is superimposed on the high ignition voltage results in advantageous combustion in the combustion chamber of the internal combustion engine by means of an ignition spark and a subsequent plasma process.

The high ignition voltage or the high-voltage pulse (hereinafter also referred to as HV signal) and the superimposed high-frequency signal (hereinafter also referred to as HF signal) can be generated in a common circuit device. In principle, however, it is also possible to generate the high ignition voltage and/or the high-frequency signal separately and to supply them/it to the circuit device or to superimpose the high-frequency signal on the high ignition voltage in the circuit device.

The coupling in or superimposing on the high ignition voltage can be carried out using methods that are known in principle.

The high ignition voltage can preferably be generated with the aid of an ignition coil.

The ignition coil and the means for coupling a high-frequency signal into the high ignition voltage can be embodied as parts of the circuit device. The high ignition voltage can, however, also be generated outside of the circuit device and transmitted to the circuit device, for example, by a cable or a (high-voltage) supply line.

In order to be able to carry out the combustion process by igniting the fuel mixture by means of the high ignition voltage and the high-frequency signal superimposed thereon, the apparatus has the transmission element already mentioned.

According to the invention, the transmission element has a contact element which is provided, at least along a section of its longitudinal axis, with an electrically conductive coating, wherein the impedance of the coating is lower than the impedance of the contact element.

Impedance is also known as alternating current resistance and is an electrical resistance in alternating current technology. Impedance is a physical quantity used to describe the property of a line during electromagnetic wave propagation. The impedance is a summary of the following two statements. It indicates the ratio of the amplitudes of sinusoidal alternating voltage to sinusoidal alternating current. It also indicates the shift in the phase angles between these two quantities.

The transmission of the high ignition voltage on which the high-frequency signal is superimposed is optimized because the transmission element has a contact element which is provided with a coating of an electrically conductive material with the mentioned property at least along a section of its longitudinal axis, and preferably along an entirety of the longitudinal axis.

According to the invention, it can be provided that the lower impedance of the coating compared to the contact element results from the fact that magnetic permeability of the coating is lower than the magnetic permeability of the contact element and/or the electrical conductivity of the coating is higher than the electrical conductivity of the contact element.

The contact element can have a high electrical conductivity and a low permeability and thus a low impedance. The contact resistance and the direct current conductivity are thus improved. The apparatus according to the invention enables optimized transmission of the high-voltage signal and, at the same time, of the high-frequency signal.

The coating provided according to the invention, which has a lower impedance than the contact element itself, enables optimized transmission of the high-frequency signal, while the contact element advantageously serves to transmit the high-voltage signal or the high voltage. The transmission element according to the invention thus optimizes the transmission of both signals.

The coating preferably has both a permeability which is lower than the permeability of the contact element and an electrical conductivity which is higher than the electrical conductivity of the contact element. The fact that the coating has the two properties mentioned advantageously results in the coating also having lower impedance than the contact element.

The coating according to the invention can preferably be formed by using for the coating a material, in particular a metal, which has the properties mentioned. It is also possible, as shown in more detail below, to assemble the coating from several different materials, preferably in layers on top of one another, so that overall a coating with the inventive impedance or the desired properties results. In the context of the invention, it can already be sufficient if one layer of the coating has a lower impedance than the contact element. Preferably, however, even if the coating is formed from several materials or layers, it has overall lower impedance than the impedance of the contact element.

The high ignition voltage on which the high-frequency signal is superimposed can be transmitted completely or essentially via the coating made of the electrically conductive material. It is advantageous here if the contact element itself also contributes to the transmission. The inventors have recognized that it is particularly advantageous if the high-frequency signal is transmitted at least essentially, preferably completely, via the coating. It is also advantageous if the high ignition voltage is applied to the largest possible line cross-section, i.e. the high ignition voltage or the high-voltage signal is transmitted over the largest possible line cross-section, for which purpose it is advantageous if the contact element is used for transmission.

The high-frequency signal is thus preferably transmitted at least essentially via the coating and the high ignition voltage is transmitted at least essentially via the contact element.

The contact element itself can thus have a structure that does not have to be optimized for high-frequency signal transmission. The contact element is preferably constructed in such a way that it enables robust contact at its ends, in particular for bringing about a connection between the ignition system, for example an ignition coil and the spark plug. Furthermore, the contact element is preferably embodied in such a way that it can compensate for an offset between the ignition system and the spark plug. In the context of the invention, the contact element is preferably designed to transmit the high-voltage signal.

According to the invention it can be provided that the magnetic permeability of the coating is lower than the magnetic permeability of steel and/or that the electrical conductivity of the coating is higher than that of stainless steel, preferably higher than the electrical conductivity of iron.

The magnetic permeability or permeability number $\mu_r$ of the coating can be less than 1000, preferably less than 100, and particularly preferably less than 10 and very particularly preferably less than 1.

It is advantageous if the electrical conductivity ($\sigma$) of the coating is higher than the electrical conductivity of iron. The electrical conductivity of the coating is preferably at least $1.4\times10^6$ Siemens per meter (S/m). The electrical conductivity of the coating is particularly preferably at least $10\times10^6$ Siemens per meter (S/m) and very particularly preferably at least $19\times10^6$ Siemens per meter (S/m), in particular at least $37\times10^6$ Siemens per meter (S/m).

A contact element with a coating with the aforementioned electrical conductivity and/or the aforementioned permeability is particularly suitable for satisfying the object according to the invention, in particular for transmitting a high ignition voltage on which a high-frequency signal is superimposed.

According to the invention it can be provided that the coating has several layers.

Forming the coating from several layers, makes it possible to combine various properties of the materials that form the individual layers of the coating. It can be provided that if the coating is formed from several layers, at least two layers are formed from a different material. Two layers, which consist of two different materials, are preferably provided. The coating is particularly preferably formed from three layers which consist of two or preferably three different materials. According to the invention, it can also be provided that the coating has more than three layers which are composed of two, three or more materials.

If the coating has a layer structure, it can preferably have at least a first layer made of a first material, a second layer made of a second material and preferably a third layer made of a third material and optionally a fourth or a further layer each in turn respectively made of different materials.

It has been found to be particularly suitable if the layer applied first to the contact element is one which adheres in a particularly advantageous manner to the contact element, in particular if the latter is made of iron or steel. A copper layer can be particularly suitable for this. In order to form the second layer, it can be advantageous if it performs the function of a diffusion barrier, i.e. is embodied as a diffusion layer. A nickel layer can be particularly suitable for this. The third layer can preferably be formed from a material which, in addition to the impedance according to the invention, also has the property of being as corrosion-resistant as possible. A gold layer, a silver layer or a tin layer can be particularly suitable for this.

If the coating is made up of several layers, the materials that form the individual layers are preferably selected such that the coating composed of the layers has an overall lower impedance than the contact element and preferably both the magnetic permeability of the coating is lower overall than the magnetic permeability of the contact element and the electrical conductivity of the coating is greater overall than the electrical conductivity of the contact element.

However, within the scope of the invention it can also be provided that only one or more of the layers satisfy the properties mentioned. This can be the case in particular when one of the layers of the coating, for example the contact layer, primarily takes on a different function, namely the formation of contact, or a layer is optimized to form a particularly advantageous diffusion layer. Preferably, however, the coating as a whole satisfies the stated properties and preferably the materials from which the individual layers are formed also satisfy in each case the stated properties individually.

Insofar as a material which forms the coating is mentioned in the context of the invention, if the coating has a structure made up of several layers, it can analogously also comprise several materials which preferably together satisfy the stated properties of the mentioned material. In the context of the invention, however, it can already be sufficient if one of the materials from which the coating is composed in a layer structure has the desired properties. The invention is to be understood accordingly.

The coating is preferably formed from metal. When the coating is formed from several layers, it is preferably provided that at least one, two, three or more or all of the layers of the coating are formed from metal or metals.

It is advantageous if the coating or at least one, two, three or more or all of the layers of the coating is/are formed from silver, copper, gold, tin, aluminium, tungsten, molybdenum, titanium, zirconium, niobium, tantalum, bismuth, palladium, lead, an alloy, mainly comprising one or more of these materials, or from a composite material composed of one of these materials.

The aforementioned materials are particularly suitable because they have both an electrical conductivity that is significantly greater than the electrical conductivity of stainless steel and, in addition, the magnetic permeability of the material is lower than the magnetic permeability of steel.

It is advantageous if the coating has a thickness of 1.0 μm to 30 μm, preferably 2.0 μm to 25 μm, more preferably 3.0 μm to 25 μm and very particularly preferably 4.0 μm to 25 μm.

The thickness of the coating can depend on the intended frequency for the high-frequency signal. The aforementioned values have proven to be particularly suitable for the transmission of a high ignition voltage on which a high-frequency signal is superimposed, since as a result the losses which occur owing to the so-called skin effect, i.e. the effect that the current density inside the conductor is lower in electrical conductors through which high-frequency alternating current flows than resulting losses in the outer area are minimized. This is possible by virtue of the fact that the coating has lower impedance than the contact element.

According to the invention it can be provided that the contact element is made of metal, preferably steel or stainless steel. It is also particularly suitable to embody the contact element from brass, copper-beryllium or a bronze alloy.

Making the contact element from metal, preferably from steel or stainless steel, has proven to be particularly suitable. Such a design of the contact element enables robust contact to be made with the spark plug or the ignition system. Furthermore, a contact element made of metal can be coated simply and reliably with the electrically conductive material. Making a contact element from steel or stainless steel is particularly suitable.

When the contact element is made of metal, preferably steel or stainless steel, it is provided that the electrically conductive coating is selected from a material whose magnetic permeability is lower than the magnetic permeability of the contact element and at the same time the electrical conductivity of the material is higher than the electrical conductivity of the contact element. The aforementioned preferably provided materials, and in particular also copper, silver, gold or tin, are particularly suitable for this. The materials preferably provided for the coating, in particular copper, silver, gold or tin, have electrical conductivity that is higher than the electrical conductivity of steel or stainless steel. In addition, these materials have a magnetic permeability that is lower than that of steel or stainless steel.

The contact element can also be made from a non-metallic material.

In one configuration of the solution according to the invention, it can be provided that the contact element is completely provided with the coating on the outside from a first end to a second end. If necessary, it can be provided that the coating is set back somewhat at the first and/or at the second end, preferably in such a way that at least 90%, preferably 95%, of the central part of the contact element is provided with the coating. However, the contact element is preferably provided with the coating over its entire (axial) length. An offset of the coating with respect to the contact element can, if necessary, primarily be advantageous in order to enable suitable attachment of the contact element. It is advantageous if the coating or a high-voltage conductor connected to the coating extends to the spark plug in order to establish an electrically conductive connection to the ignition system or to a high-voltage conductor connected to the ignition system directly via the spark plug.

According to the invention it can be provided that the contact element is embodied as a high-voltage conductor.

It is advantageous if the contact element is embodied at least in certain sections as a contact spring, preferably as a spiral spring.

A configuration of the contact element at least in certain sections or partially as a contact spring has the advantage that the high ignition voltage can be transmitted particularly advantageously and reliably with the superimposed high-frequency signal. The elasticity of the electrically conductive spring can compensate for manufacturing tolerances in the longitudinal direction of the spring. Furthermore, the contact spring can also compensate for different angles of an angled shaft in the engine block into which the contact spring is inserted as part of the transmission element. It is also suitable to use a contact spring, however, if the shaft in which the contact spring is received within the engine block is not angled. An angled course of the shaft in the engine block is basically optional, but can be particularly suitable.

The contact spring as a carrier of the coating made of the electrically conductive material thus enables the coating to reliably transmit the high voltage on which the high-frequency signal is superimposed, even when it is necessary to compensate fabrication tolerances in the longitudinal direction or an angular course of a shaft.

The contact element can be embodied as a contact spring in certain sections, but preferably completely. It has been found to be advantageous if at least 90%, preferably 95%, of the central part of the contact element is embodied as a contact spring. An incomplete embodiment of the contact element as a contact spring can be suitable, if necessary, in order to enable suitable attachment of the contact element, in particular in the area of the ends of the contact element.

The contact spring is preferably embodied and arranged such that it presses against a suitable coupling unit of the spark plug and an electrically conductive connection with the spark plug is established via the coating.

In an alternative embodiment of the invention it can be provided that the contact element is at least in certain sections formed from a resilient material and/or at least in certain sections as a spring arm.

The contact element can also be embodied entirely as a spring arm or from a resilient material. It is also conceivable that the contact element is embodied in certain sections as a spring arm or from a resilient material and in certain sections as a contact spring.

Embodying the contact element as a spring arm or from a resilient material also makes it possible to compensate for tolerances and to take into account an angular course of the shaft in an engine block.

It is advantageous if the transmission element has an insulation element which surrounds the contact element.

In particular, in a configuration as a contact spring, the contact element is preferably received or guided in a drilled hole in the insulation element. The insulation element preferably has a sealing function. The insulation element is preferably made of rubber or a rubber-like material.

Making the insulation element from rubber or a rubber-like material and embodying the contact element as a spring particularly advantageously permit fabrication tolerances and angular deviations to be compensated. Furthermore, the transmission element thus formed is particularly elastic or has an elasticity that is advantageous for the intended use.

In addition to the sealing function, the insulation element can advantageously also perform the task of providing electrical insulation between the coating of the contact element and the engine block or the circuit housing, in particular at the junction with a circuit housing of the circuit device and at the junction with the engine block.

The insulation element is preferably embodied as a jacket that surrounds the electrically conductive coating of the contact element in a close-fitting manner or at a distance, for example in such a way that a tubular passage is formed in the jacket. Such a configuration is suitable both when the insulation element is made of rubber or a rubber-like material or also of another insulating material.

The configuration is particularly suitable when the contact element is embodied as a contact spring.

The configuration according to the invention makes it possible to transfer the high ignition voltage on which the high-frequency signal is superimposed to the spark plug, in particular a center electrode of the spark plug, via the contact element provided with the electrically conductive coating, while in a particularly advantageous manner the ground electrode of the spark plug, to which the spark jumps from the center electrode, is connected to the ground potential of the circuit device, in particular to the circuit housing and the circuit. This configuration enables the advantageous use of a high ignition voltage with a superimposed high-frequency signal in order to optimize the combustion process in a combustion chamber.

It is advantageous if an electrically conductive shielding element is provided which surrounds the contact element in an electromagnetically shielding manner at least along a section of its longitudinal axis, wherein the shielding element is electrically conductively connected to a ground potential of the circuit device and the shielding element establishes a connection between the ground potential of the circuit device and a ground electrode of the spark plug.

Furthermore, it is advantageous if the circuit device comprises a circuit housing which electromagnetically shields the circuit, wherein the shielding element is connected to a ground potential of the circuit housing and/or to a ground potential of the circuit.

So that the combustion process in a gasoline engine can be ignited particularly advantageously by a high ignition voltage on which a high-frequency signal is superimposed, it is advantageous on the one hand to shield the electrically conductive coating and on the other hand to establish a connection between the ground potential of the circuit device and the ground electrode of the spark plug. The shielding element also undertakes shielding the ignition signal consisting of the high ignition voltage and the superimposed high-frequency signal against external interference. Furthermore, it can be advantageous to shield the ignition signal in such a way that it does not influence adjacent electronics, in particular so as not to interfere with the sensitive electronics, for example in a motor vehicle, or to impair them as little as possible.

The combustion process is also optimized in that the ground potential of the circuit device and the ground electrode of the spark plug are electrically connected to one another.

In the following, the ground potential is also referred to as "ground" for the sake of simplicity.

It is advantageous if the shielding element produces potential equalization between the ground electrode of the spark plug and the circuit device.

The shielding element prevents or reduces both electromagnetic radiation from the electrically conductive coating and electromagnetic radiation into the electrically conductive coating.

In conjunction with the inventive coating of the contact element, the shielding element enables good electromagnetic compatibility (EMC), which means that optimized combustion is possible through a high ignition voltage with a superimposed high-frequency signal.

The shielding element encompasses the contact element provided with the coating at least along a section of the contact element's longitudinal axis, preferably completely. However, it is also possible, in particular to ensure good mobility of the contact element or the transmission element, that the shielding element has expansion joints, recesses, gaps, incisions or notches in order to permit movement of the contact element or of the transmission element in a radial and/or axial direction, in particular for tolerance compensation.

According to the invention it can be provided that the shielding element encompasses the insulation element on the outside at least along a section of the insulation element longitudinal axis.

This solution has proven to be particularly suitable. The shielding element is preferably embodied in such a way that it encompasses the electrically conductive coating of the contact element by virtue of the fact that the insulation element, which receives the electrically conductive coating of the contact element, is surrounded or encased by the shielding element on the outside.

The shielding element can be embodied, as described above, in order to ensure radial mobility. Preferably, however, the shielding element encompasses or surrounds the insulation element completely or in a circumferentially closed fashion along the axial section.

Because the circuit device preferably comprises a circuit housing which accommodates the circuit and shields the circuit electromagnetically, i.e. electrically and/or magnetically, the high ignition voltage on which the high-frequency signal is superimposed is shielded in a particularly suitable manner within the circuit device.

It is advantageous if the shielding element is connected to a ground potential of the circuit housing and/or a ground potential of the circuit. It is particularly preferable if the ground potential of the circuit is connected to the ground potential of the circuit housing. Furthermore, it is preferable, in particular for this embodiment, that the shielding element is connected to the ground potential of the circuit housing. The circuit housing can preferably have a through-hole into which the shielding element is inserted.

The shielding element and/or the insulation element is preferably embodied as part of the transmission element.

It can be advantageous if the shielding element extends up to the engine block in order to establish an electrical connection between the ground potential of the circuit device, in particular the circuit housing and the circuit, and the ground electrode of the spark plug via the engine block.

Such a configuration can be achieved particularly advantageously in that the shielding element comprises only a section of the longitudinal axis of the insulation element. The axial section preferably begins at a first end of the insulation element, which is preferably connected to the circuit housing, and extends in the direction of the second end of the insulation element, preferably in such a way that an electrical connection is established between the ground potential of the circuit housing and the engine block.

In a further development of the invention, it can also be provided that the shielding element encompasses, starting from a first end of the insulation element, only a section of the longitudinal axis of the insulation element on the outside, with a ground conductor being extended to a second end of the insulation element facing the spark plug.

This solution has the advantage that on the one hand good shielding, in particular shielding to improve the EMC, is provided in the area between the circuit device, in particular a circuit housing, and the engine block, but the connection between the ground potential of the circuit device and the ground electrode does not necessarily depend on the engine block. The ground line, which is continued up to a second end of the insulation element facing the spark plug, can in this case, provide the electrical connection. This has the advantage that the engine block itself does not necessarily have to be connected to the spark plug. This increases the design freedom when designing the shaft provided for the spark plug in the engine block.

In a further embodiment of the solution according to the invention, it can be provided that the shielding element encompasses the insulation element on the outside from a first end to the second end. If necessary, it can be provided that the shielding element at the first and/or the second end is set back somewhat relative to the insulation element, preferably in such a way that at least 90%, preferably 95% of the central part of the insulation element is surrounded by the shielding element. In this embodiment, however, the insulation element is preferably surrounded by the shielding element over its entire (axial) length. An offset of the shielding element with respect to the insulation element can primarily be advantageous in order to enable suitable attachment of the transmission element or to avoid adverse effects on the sealing function of the insulation element.

It can be provided that the shielding element or a ground conductor connected to the shielding element extends up to the spark plug in order to establish an electrically conductive connection between the circuit device, in particular the circuit housing and the circuit, and the ground electrode of the spark plug directly via the spark plug.

The connection of the ground electrode to the circuit device, in particular a circuit housing, is thus possible independently of the engine block.

It can be provided that the shielding element is at least partially formed by metallization of the insulation element.

Metallization is particularly suitable for creating an electrically conductive connection for equipotential bonding and also for shielding.

The invention also relates to a transmission element for transmitting an ignition signal from an ignition system to a spark plug, having a contact element, wherein the contact element is provided with an electrically conductive coating at least along a section of its longitudinal axis, wherein the impedance of the coating is lower than the impedance of the contact element, and wherein the contact element is at least in certain sections embodied as a contact spring and/or as a spring arm and/or made from a resilient material.

With regard to the advantages and configurations of the transmission element, reference is made to the statements above and also to the following.

According to the invention, it can be provided that the lower impedance of the coating compared to the contact element results from the fact that magnetic permeability of the coating is lower than the magnetic permeability of the contact element and/or the electrical conductivity of the coating is higher than the electrical conductivity of the contact element.

According to the invention it can be provided that the magnetic permeability of the coating is lower than the magnetic permeability of steel and/or that the electrical conductivity of the coating is higher than that of stainless steel, preferably higher than the electrical conductivity of iron.

In the context of the transmission element according to the invention it is preferably provided that the electrical conductivity of the material of the coating is higher than the electrical conductivity of iron.

It is advantageous if the electrical conductivity ($\sigma$) of the material of the coating is at least $1.4\times10^6$ Siemens per meter (S/m), preferably $10\times10^6$ Siemens per meter (S/m).

It is advantageous if the coating has several layers.

It is advantageous if the coating is formed from metal or at least one, two, three or more or all of the layers of the coating is/are formed from metal or metals.

It is preferable if the coating or at least one, two, three or more or all of the layers of the coating is/are formed from silver, copper, gold, tin, aluminium, tungsten, molybdenum, titanium, zirconium, niobium, tantalum, bismuth, palladium, lead, an alloy, mainly comprising one or more of these materials, or from a composite material composed of one of these materials.

The coating preferably has a thickness of 1.0 μm to 30 μm, preferably 2.0 μm to 25 μm, more preferably 3.0 μm to 25 μm, and very particularly preferably 4.0 μm to 25 μm.

According to the invention it can be provided that the contact element is made of metal, preferably steel or stainless steel. However, any other material is also fundamentally suitable for forming the contact element, since it may be sufficient within the scope of the invention if the ignition signal is transmitted via the electrically conductive coating.

It is advantageous if the transmission element has an insulation element which surrounds the contact element provided with the coating.

It is also advantageous if the transmission element has an electrically conductive shielding element which surrounds the insulation element on the outside of the insulation element at least along a section of its longitudinal axis.

The transmission element according to the invention is suitable for transmitting any ignition signal. The ignition signal can be both a high ignition voltage (HV signal) and a high-frequency signal, in particular a high-frequency plasma ignition apparatus. However, the transmission element is particularly suitable for transmitting a high ignition voltage on which a high-frequency signal is superimposed. A circuit device can be provided which comprises a circuit for superimposing a high-frequency signal on a high ignition voltage, which high-frequency signal is then transmitted to the spark plug by means of the transmission element, in particular the coating of the contact element of the transmission element. The ignition signal to be transmitted is thus preferably a high ignition voltage on which a high-frequency signal is superimposed, preferably as has already been explained with regard to the apparatus according to the invention.

The invention also relates to an ignition device, with an ignition system for generating an ignition signal and with a transmission element for transmitting the ignition signal to a spark plug.

The transmission element can be embodied in one configuration, and with the variants that are described above and below, in order to transmit the ignition signal. The ignition signal can be a high ignition voltage (HV signal) or a high-frequency signal (HF signal). The ignition signal is preferably a high ignition voltage on which a high-frequency signal is superimposed, preferably as has already been explained with regard to the apparatus according to the invention.

The invention further relates to a circuit device for superimposing a high-frequency signal on a high ignition voltage, and with a transmission element in order to transmit the high ignition voltage on which the high-frequency signal is superimposed to the spark plug.

Features that have already been described in connection with the apparatus according to the invention for igniting a fuel mixture can of course also be applied accordingly to the transmission element, the ignition device and the circuit device—and vice versa. Furthermore, advantages that have already been mentioned in connection with the apparatus according to the invention for igniting a fuel mixture can also be understood to relate to the transmission element, the ignition device and the circuit device—and vice versa.

It should additionally be pointed out that terms such as "comprising", "including" or "having" do not exclude other features or steps. Furthermore, terms such as "a(n)" or "the" indicating steps or features in the singular do not exclude a plurality of features or steps and vice versa.

SUMMARY

A principal aspect of the present invention is an apparatus for igniting a fuel mixture comprising: an ignition system for generating a high ignition voltage; a circuit device, having a circuit for superimposing a high-frequency signal on the high ignition voltage; a spark plug arranged in an engine block; a transmission element for transmitting the high ignition voltage on which the high-frequency signal is superimposed to the spark plug, and wherein the transmission element has a contact element that has an electrically conductive coating, at least along a section of the contact element's longitudinal axis, and the electrically conductive coating has an impedance that is lower than an impedance of the contact element.

A further aspect of the present invention is an apparatus wherein, magnetic permeability of the electrically conductive coating is lower than magnetic permeability of the contact element.

A further aspect of the present invention is an apparatus wherein the magnetic permeability of the electrically conductive coating is lower than the magnetic permeability of steel.

A further aspect of the present invention is an apparatus wherein the electrically conductive coating has an electrical conductivity of at least $1.4\times10^6$ Siemens per meter (S/m), and preferably at least of $10\times10^6$ Siemens per meter (S/m).

A further aspect of the present invention is an apparatus wherein the electrically conductive coating has several layers.

A further aspect of the present invention is an apparatus wherein the electrically conductive coating is at least partially formed from metal.

A further aspect of the present invention is an apparatus wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy, mainly comprising one or more of these materials, or from a composite material composed of one of these materials.

A further aspect of the present invention is an apparatus wherein the electrically conductive coating (20) has a thickness of between approximately 1.0 μm to 30 μm, and preferably between approximately 2.0 μm to 25 μm.

A further aspect of the present invention is an apparatus wherein the contact element is made of metal.

A further aspect of the present invention is an apparatus wherein the contact element is a spring.

A further aspect of the present invention is an apparatus wherein the contact element is formed, at least partially, of a resilient material.

A further aspect of the present invention is an apparatus further comprising: an insulation element which surrounds the contact element.

A further aspect of the present invention is an apparatus further comprising: an electrically conductive shielding element which surrounds the contact element in an electromagnetically shielding manner at least along a section of the longitudinal axis, and wherein the electrically conductive shielding element is electrically conductively connected to a ground potential of the circuit device and the electrically conductive shielding element establishes a connection between a ground potential of the circuit device and a ground electrode of the spark plug.

A further aspect of the present invention is an apparatus further comprising: a circuit housing which electromagnetically shields the circuit, and wherein the electrically conductive shielding element is connected to at least one of a ground potential of the circuit housing and a ground potential of the circuit.

A further aspect of the present invention is a transmission element for transmitting an ignition signal from an ignition system to a spark plug, the transmission element comprising: a contact element defining a longitudinal axis and having an electrically conductive coating at least along a section of the longitudinal axis, and wherein the electrically conductive coating has an impedance, and the impedance of the electrically conductive coating is lower than an impedance of the contact element.

A further aspect of the present invention is a transmission element wherein magnetic permeability of the electrically conductive coating is lower than magnetic permeability of the contact element.

A further aspect of the present invention is a transmission element wherein the magnetic permeability of the electrically conductive coating is lower than the magnetic permeability of steel.

A further aspect of the present invention is a transmission element wherein the electrically conductive coating has several layers.

A further aspect of the present invention is a transmission element wherein the electrically conductive coating is at least partially formed from metal.

A further aspect of the present invention is a transmission element wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy.

A further aspect of the present invention is a transmission element wherein the contact element is made of metal, and preferably steel or stainless steel.

A further aspect of the present invention is a transmission element and further comprising: an insulation element which surrounds the contact element having the electrically conductive coating.

A further aspect of the present invention is a transmission element and further comprising: an electrically conductive shielding element which surrounds the insulation element at least along a section of a longitudinal axis of the insulation element, and on an outside of the insulation element.

A further aspect of the present invention is an ignition device comprising: an ignition system for generating an ignition signal; and a transmission element having, a contact element that is formed of metal and defines a longitudinal axis and has an electrically conductive coating at least along a section of the longitudinal axis, and wherein the electrically conductive coating has an impedance that is lower than an impedance of the contact element, and wherein the contact element is at least partially, at least one of a contact spring and a spring arm, and is at least partially formed of resilient material, and wherein electrical conductivity of the electrically conductive coating is higher than electrical conductivity of the contact element, and wherein the electrically conductive coating has several layers, and wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy, comprising at least one of these materials, and an insulation element which surrounds the contact element that has the electrically conductive coating, and an electrically conductive shielding element surrounds the insulation element at least along a section of a longitudinal axis of the insulation element, and on an outside of the insulation element; and to transmit the transmission element transmits the ignition signal to a spark plug.

A further aspect of the present invention is an circuit device for superimposing a high-frequency signal on a high ignition voltage, comprising: a transmission element having, a contact element that is formed of metal and defines a longitudinal axis and has an electrically conductive coating at least along a section of the longitudinal axis, and wherein the electrically conductive coating has an impedance that is lower than an impedance of the contact element, and wherein the contact element is at least partially, at least one of a contact spring and a spring arm, and is at least partially formed of resilient material, and wherein electrical conductivity of the electrically conductive coating is higher than electrical conductivity of the contact element, and wherein the electrically conductive coating has several layers, and wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy, comprising at least one of these materials, and an insulation element which surrounds the contact element that has the electrically conductive coating, and an electrically conductive shielding element surrounds the insulation element at least along a section of a longitudinal axis of the insulation element, and on an outside of the insulation element; and the transmission element transmits the high ignition voltage, on which the high-frequency signal is superimposed, to a spark plug.

A further aspect of the present invention is an apparatus wherein, electrical conductivity of the electrically conductive coating is higher than electrical conductivity of the contact element.

A further aspect of the present invention is an apparatus wherein electrical conductivity of the electrically conductive coating is higher than electrical conductivity of at least one of stainless steel and iron.

A further aspect of the present invention is an apparatus wherein the electrically conductive coating has a thickness of between approximately 3.0 μm to 25 μm and preferably a thickness between approximately 4.0 μm to 25 μm.

A further aspect of the present invention is an apparatus wherein the contact element is formed, at least partially, as a spring arm.

A further aspect of the present invention is a transmission element wherein the contact element is at least partially at least one of a contact spring and a spring arm.

A further aspect of the present invention is a transmission element wherein the contact element is made of a resilient material.

A further aspect of the present invention is a transmission element wherein electrical conductivity of the electrically conductive coating is higher than electrical conductivity of the contact element.

A further aspect of the present invention is a transmission element wherein electrical conductivity of the electrically conductive coating is higher than electrical conductivity of at least one of stainless steel and iron.

These and other aspects of the current invention are set forth and described herein as is required.

BRIEF DESCRIPTIONS OF THE FIGURES

An exemplary embodiment of the invention is described in more detail below with reference to the drawings.

The figures each show preferred exemplary embodiments, in which individual features of the present invention are illustrated in combination with one another. However, the features of the exemplary embodiment can also be implemented separately from the other features of the exemplary embodiment and can accordingly be easily combined by a person skilled in the art to form further useful combinations and subcombinations.

DETAILED WRITTEN DESCRIPTION OF THE PREFERRED EMBODIMENTS

The basic principle and the basic functioning of an internal combustion engine, in particular an internal combustion engine of a motor vehicle, and the associated apparatus for igniting a fuel-air mixture in a combustion chamber, in particular a cylinder of the engine, are well known from the general prior art. Internal combustion engines with external ignition by spark plugs, so-called Otto engines, and in particular also with direct injection, are in particular also known.

Their mode of operation is therefore not discussed in more detail below.

The generation of a high ignition voltage by means of an ignition system 1, which transforms a battery voltage to a required ignition voltage, is also known in principle. The generation of a high-frequency signal, in particular a high-frequency plasma ignition apparatus for igniting a fuel-air mixture in a combustion chamber of an internal combustion engine, is also known in principle, for which reference is also made to DE 20 2012 004 602 U1. This is also not discussed in more detail below.

The exemplary embodiment is described on the basis of the transmission of a high ignition voltage (HV signal or HV pulse) on which a high-frequency signal is superimposed. However, the superimposition element according to the invention is also suitable for the transmission of another ignition signal, for example based on a high ignition voltage or a high-frequency signal. The transmission element according to the invention is not limited to the transmission of a specific ignition signal, but is particularly suitable for the transmission of a high ignition voltage on which a high-frequency signal is superimposed. Furthermore, the ignition device shown in the exemplary embodiment is not limited to the generation of a high ignition voltage on which a high-frequency signal is superimposed. The ignition signal which the ignition device generates can be any ignition signal, as already explained with regard to the transmission element.

Figure 1:
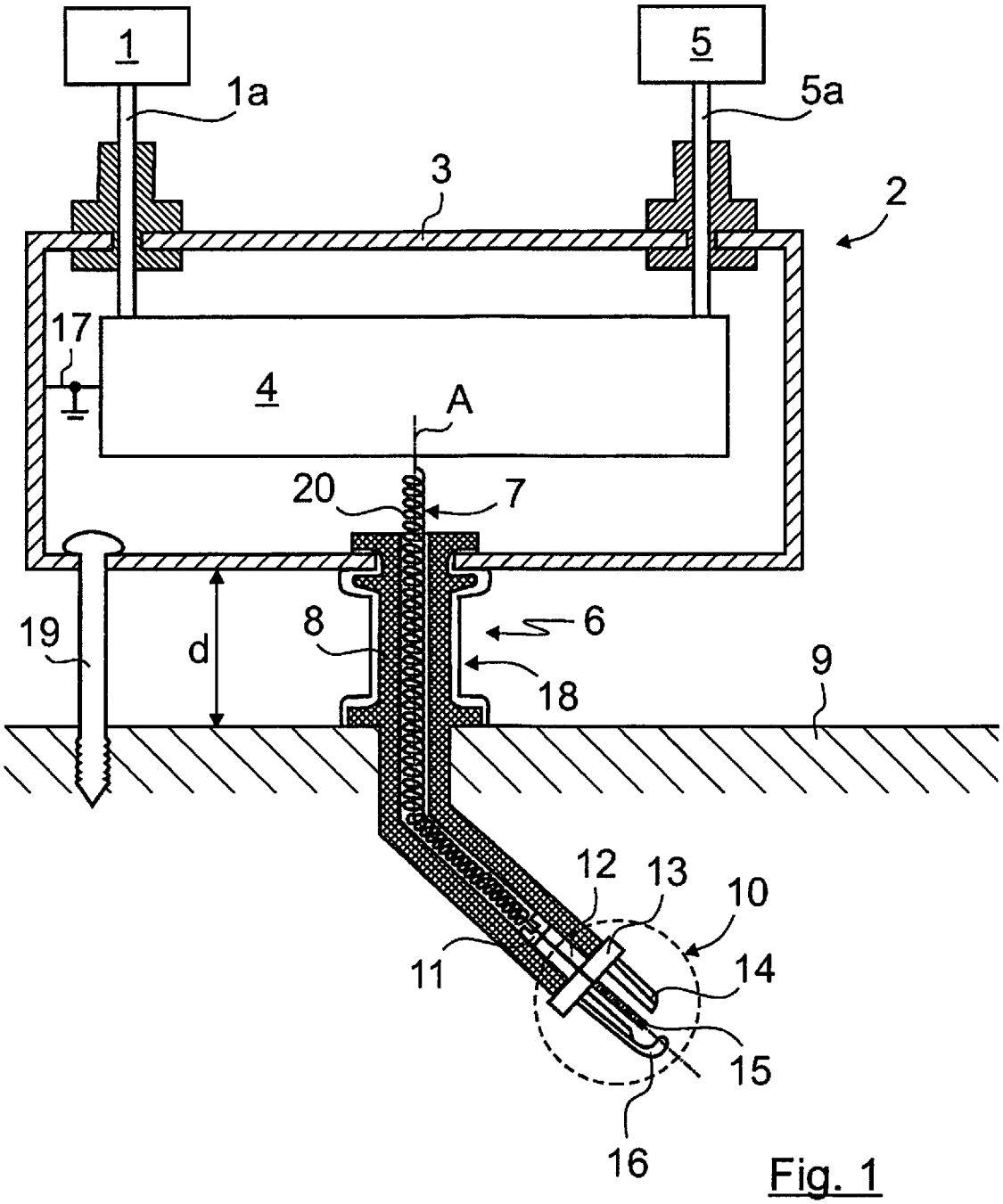
FIG. 1 is a cross-section illustration of the device according to the invention showing a circuit housing of a circuit device and of a transmission element.

The apparatus shown in FIG. 1 shows a particularly suitable structure. However, the use of the transmission element is not limited to a specific structure of an apparatus for igniting a fuel mixture, but can be used in any desired structure. The exemplary embodiment is therefore also isolated as a disclosure of a transmission element, without being restricted to the features of the apparatus shown for igniting a fuel mixture, wherein the use of the transmission element is particularly suitable for the illustrated apparatus.

FIG. 1 shows an apparatus for igniting a fuel mixture, in particular a fuel-air mixture, with an ignition system 1, shown only in principle, for generating a high ignition voltage (HV pulse) and a circuit device 2.

In the exemplary embodiment, the circuit device 2 comprises a circuit housing 3 and a circuit 4 for superimposing a high-frequency signal (HF signal) on the high ignition voltage. In the exemplary embodiment, the high-frequency signal is generated by means of a high-frequency generator 5. The high-frequency signal generated by the high-frequency generator 5 is fed to the circuit 4 via a high-frequency lead 5*a*. Correspondingly, the high ignition voltage generated by the ignition system 1 is also fed to the circuit 4 via a high-voltage lead 1*a*.

Alternatively, the ignition system 1 and/or the high-frequency generator 5 and/or another apparatus for generating the high ignition voltage or the high-frequency signal can also be integrated into the circuit device 2, in particular into the circuit housing 3 and possibly also into the circuit 4.

The generation of the high ignition voltage or a corresponding high-voltage pulse and the high-frequency signal can in principle take place in any known manner within the scope of the invention.

A transmission element 6 is also provided, which has a contact element 7 which is guided in an insulation element 8.

As can be seen from FIG. 1, the transmission element 6 extends as far as a spark plug 10 arranged in an engine block 9.

The spark plug 10 can have any suitable structure for igniting a fuel-air mixture. As can be seen from the basic illustration of FIG. 1, the spark plug 10 in the exemplary embodiment has a metallic connection part 11, a ceramic part 12, a flange 13 with an integrated crimped ring for holding the ceramic part 12 in place, a screw-in thread 14, a center electrode 15 and a ground electrode 16.

The structure of the spark plug 10 can also differ; in particular, instead of a center electrode 15 insulated by means of a ceramic part 12, some other type of insulation can optionally also be provided.

The structure of spark plugs and the different variants are known from the prior art.

The spark plug 10 is located in a shaft of the engine block 9. The shaft in the engine block 9 does not have to run at an angle, as shown in the exemplary embodiment, (FIG. 1), but can have any desired course, possibly also a non-angled course.

In the exemplary embodiment, it is provided that the spark plug 10 is connected to the engine block 9 in an electrically conductive manner via the screw-in thread 14.

The circuit housing 3 is designed to be electrically conductive in the exemplary embodiment according to FIG. 1, so that the circuit 4 is electromagnetically shielded. The circuit 4 can be connected to the circuit housing 3 via a ground line 17, so that the circuit housing 3 and the circuit 4 have the same ground potential.

Figure 2:
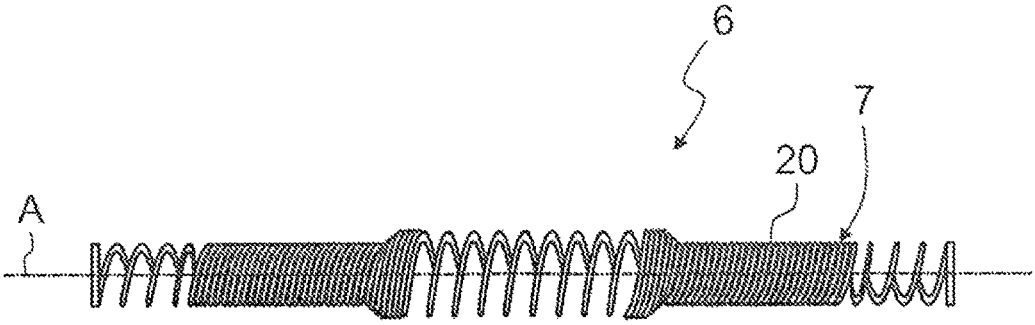
FIG. 2 is an orthographic side view of a contact element embodied as a contact spring.

In the exemplary embodiment, the contact element, as shown in more detail in FIG. 2, is embodied as a contact spring 7, preferably as a spiral spring. However, the exemplary embodiment is not restricted to this. The embodiment of the contact element as a contact spring 7 is also particularly suitable, however, in particular to compensate for tolerances.

The contact element 7 can optionally also be embodied such that it is embodied as a spring only over a portion of its longitudinal axis A or (axial) length.

In the exemplary embodiment (see FIG. 1) it is also optionally provided that the insulation element 8 encompasses or encases the contact spring 7. This can preferably be achieved in that the insulation element 8 has a central hole, which may be a drilled hole for receiving the contact spring 7.

The insulation element 8 can be embodied as part of the transmission element 6.

The insulation element 8 is preferably made of rubber or a rubber-like material, but the exemplary embodiment is not limited to this.

In the exemplary embodiment, the insulation element 8 also fulfils the function of a sealing part or takes on a sealing function. In the exemplary embodiment, it is provided that the insulation element 8 seals both the junction with the circuit housing 3 and the junction area with the engine block 9, so that no moisture can penetrate. For this purpose, the insulation element 8 can be designed accordingly, preferably having grooves, for example, for positively locking accommodation, a wall of the circuit housing 3 and/or annular extensions, as shown in principle in FIG. 1.

As can be seen from FIG. 1, an electrically conductive shielding element 18 is also (optionally) provided or formed. The electrically conductive shielding element 18 comprises and shields the contact spring 7 here at least along a section of the longitudinal axis A of the contact spring 7.

The shielding element 18 can be embodied as part of the transmission element 6.

In FIG. 1 it is shown that the shielding element 18 encompasses the contact spring 7 in an electromagnetic shielding manner only over part of the contact elements 7 axial length or the longitudinal axis A. The shielding element 18 is preferably embodied here in such a way that the shielding element 18 encompasses the contact spring 7 to such an extent that the distance d between the circuit housing 3 and the engine block 9 is shielded.

In an embodiment not shown, it can be provided that the shielding element 18 encompasses the contact spring 7 outside the circuit housing 3 up to the spark plug 10. That is to say the contact spring 7 is surrounded almost over its entire length by the shielding element 18 outside the circuit housing.

The shielding element 18 is connected in an electrically conductive manner to a ground or to the ground potential of the circuit device 2. The shielding element 18 establishes a connection between the ground of the circuit device 2 and the ground electrode 16 of the spark plug 10.

In the exemplary embodiment, the shielding element is connected to the circuit housing 3 of the circuit device 2 in an electrically conductive manner. The circuit housing 3 is connected here to the circuit 4 via the ground line 17, as already described, so that the circuit 4, the circuit housing 3 and also the shielding element 18 have the same ground or the same ground potential.

In the exemplary embodiment, the shielding element 18 is embodied in such a way that it encompasses the insulation element 8 on the outside at least along a section of its longitudinal axis A.

FIG. 1 shows that the shielding element 18 encompasses the insulation element 8 over a portion of the longitudinal axis A thereof. As already described, the contact spring 7 is thus accordingly encompassed and shielded by the shielding element 18.

In the exemplary embodiment, it is provided that the shielding element 18 extends as far as the engine block 9 in order to establish an electrical connection between the ground of the circuit device 2 and the ground electrode 16 via the engine block 9. Alternatively, (not shown), the shielding element 18 can extend as far as the spark plug 10 in order to establish an electrically conductive connection to the ground electrode 16 of the spark plug 10 directly via the spark plug 10. The shielding element 18 is preferably connected here to the crimped ring 13 and this in turn is connected to the ground electrode 16 via the screw-in thread 14.

As can be seen from FIG. 1, it can be provided that the circuit housing 3 is fixed on the engine block 9. The area of the engine block 9 on which the circuit housing 3 is secured can be, but is not limited to, a cylinder head of the cylinder into which the spark plug 10 is inserted.

A fastening 19 for securing the circuit housing 3 is shown in principle in FIG. 1.

According to the invention, for the transmission of the ignition signal, which in the exemplary embodiment is a high ignition voltage on which a high-frequency signal is superimposed, it is provided that the contact element 7 is provided with a coating 20 of an electrically conductive material at least along a section of its axial length A. The electrically conductive material for forming the coating 20 is selected here in such a way that the impedance of the coating 20 is lower than the impedance of the contact element 7. The lower impedance of the coating 20 compared to the contact element 7 results in the exemplary embodiment from the fact that the magnetic permeability of the coating 20 is lower than the magnetic permeability of the contact element 7 and/or the electrical conductivity of the coating 20 is higher than the electrical conductivity of the contact element 7.

In the exemplary embodiment it is provided that the magnetic permeability of the coating 20 is lower than the magnetic permeability of steel and that the electrical conductivity of the coating 20 is higher than that of stainless steel.

Figure 3:
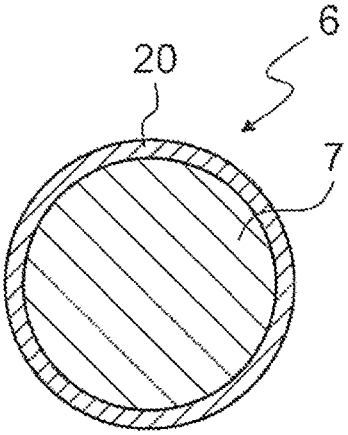
FIG. 3 is a cross section view of the contact element taken through a turn of the contact spring.

In FIG. 2, a coated contact element 7 is illustrated in a preferred embodiment as a contact spring 7 with the coating 20 applied on the outside. FIG. 3 shows the cross section through one turn of the contact spring 7. In the exemplary embodiment, the material of the coating 20 is selected such that the electrical conductivity of the material is higher than the electrical conductivity of iron. The electrical conductivity σ of the material of the coating 20 is at least $1.4\times10^6$ Siemens per meter (S/m), preferably $10\times10^6$ Siemens per meter (S/m). The coating 20 is formed from metal in the exemplary embodiment.

In one configuration, the transmission element 6 can be composed only of the contact element 7, in particular embodied as a contact spring 7, and of the coating 20. The transmission element 6 can, however, also have the insulation element 8 and/or the shielding element 18 or can be composed of these four components.

In the exemplary embodiment according to FIG. 3, it is provided that the coating 20 is formed from copper, silver, gold or tin.

In the exemplary embodiment, the coating 20 has a thickness of 1.0 μm to 30 μm, preferably 2.0 μm to 25 μm, more preferably 3.0 μm to 25 μm and very particularly preferably 4.0 μm to 25 μm.

In the exemplary embodiment it is also provided that the contact spring 7 is made of metal, preferably steel or stainless steel.

In the exemplary embodiment, the coating 20 is formed from a material which has a lower magnetic permeability than the material from which the contact element 7 is made and which has a higher electrical conductivity than the material from which the contact element 7 is made.

The contact spring 7 with the coating 20 can also be referred to as a hybrid spring.

Figure 4:
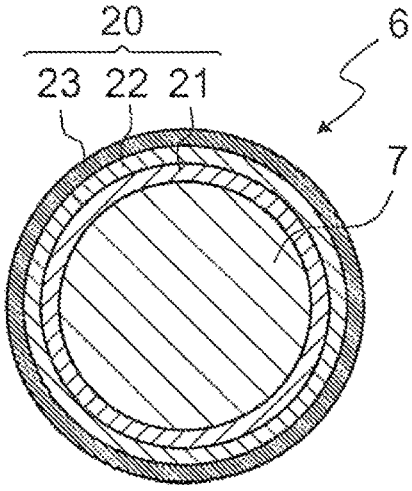
FIG. 4 is a cross section view of the contact element taken through a turn of the contact spring, and showing the coating which is made up of three layers.

Like FIG. 3, FIG. 4 shows a cross section through one turn of the contact spring 7. The exemplary embodiment according to FIG. 4 differs from FIG. 3 here in the structure of the coating 20. According to FIG. 4, it is provided that the coating 20 is formed by several layers 21, 22, 23 which together constitute the coating 20. In the exemplary embodiment it is provided that all the layers 21, 22, 23 are formed from metal. This is not absolutely necessary, however. In the exemplary embodiment it is further provided that the layers 21, 22, 23 together have the properties that have already been described above with regard to the formation of the coating 20 from only one material. However, it can also be provided that only one layer or a majority of the layers have the properties that were presented above with regard to the coating 20 as a whole. In this case, the other layers that do not have these properties, in particular the lower impedance compared to the contact element 7, can have other functions, for example they can serve as corrosion protection, diffusion protection or as an adhesive layer.

In the exemplary embodiment, it is provided that all layers 21, 22, 23 individually and in their entirety, satisfy the aforementioned properties, in particular have a lower impedance than the contact element 7.

In principle, more or fewer than three layers can also be provided in the context of the exemplary embodiment according to FIG. 4.

In the exemplary embodiment it is provided that the first layer 21 is embodied as an adhesive layer, preferably as a copper layer. In the exemplary embodiment it is also provided that the second layer 22 is embodied as a diffusion layer, preferably as a nickel layer. In the exemplary embodiment it is further provided that the third layer 23 also assumes the function of corrosion protection and for this purpose is preferably embodied as a gold layer, silver layer or tin layer. The second layer 22, which is embodied as a diffusion layer, preferably as a nickel layer, takes on the function here of avoiding or reducing diffusion of the gold, silver or tin in the direction of the copper layer.

In principle, the various layers 21, 22, 23 can be made of any suitable material.

An apparatus for igniting a fuel mixture with an ignition system (1) for generating a high ignition voltage and a circuit device (2), comprising a circuit (4) for superimposing a high-frequency signal on the high ignition voltage, and with a spark plug (10) arranged in an engine block (9) and a transmission element (6) for transmitting the high ignition voltage on which the high-frequency signal is superimposed to the spark plug (10), the transmission element (6) having a contact element (7) which is provided, at least along a section of its longitudinal axis (A), with an electrically conductive coating (20), wherein the impedance of the coating (20) is lower than the impedance of the contact element (7).

An apparatus characterized in that the lower impedance of the coating (20) compared to the contact element (7) results from the fact that the magnetic permeability of the coating (20) is lower than the magnetic permeability of the contact element (7) and/or the electrical conductivity of the coating (20) is higher than the electrical conductivity of the contact element (7).

An apparatus characterized in that the magnetic permeability of the coating (20) is lower than the magnetic permeability of steel and/or in that the electrical conductivity of the coating (20) is higher than that of stainless steel, preferably higher than the electrical conductivity of iron.

An apparatus characterized in that the electrical conductivity of the coating (20) is at least $1.4\times10^6$ Siemens per meter (S/m), preferably at least $10\times10^6$ Siemens per meter (S/m).

An apparatus characterized in that the coating (20) has several layers (21,22,23).

An apparatus characterized in that the coating (20) is formed from metal, or at least one, two, three or more or all of the layers (21,22,23) of the coating is/are formed from metal or metals.

An apparatus characterized in that the coating (20) or at least one, two, three or more or all of the layers (21,22,23) of the coating is/are formed from silver, copper, gold, tin, aluminium, tungsten, molybdenum, titanium, zirconium, niobium, tantalum, bismuth, palladium, lead, an alloy, mainly comprising one or more of these materials, or from a composite material composed of one of these materials.

An apparatus characterized in that the coating (20) has a thickness of 1.0 μm to 30 μm, preferably 2.0 μm to 25 μm, more preferably 3.0 μm to 25 μm and very particularly preferably 4.0 μm to 25 μm.

An apparatus characterized in that the contact element (7) is made of metal, preferably steel or stainless steel.

An apparatus characterized in that the contact element (7) is embodied at least in certain sections as a contact spring, preferably as a spiral spring.

An apparatus characterized in that the contact element (7) is at least in certain sections formed from a resilient material and/or at least in certain sections as a spring arm.

An apparatus characterized in that the transmission element (6) has an insulation element (8) which surrounds the contact element (7).

An apparatus characterized in that an electrically conductive shielding element (18) is provided which surrounds the contact element (7) in an electromagnetically shielding manner at least along a section of its longitudinal axis (A), wherein the shielding element (18) is electrically conductively connected to a ground potential of the circuit device (2) and the shielding element (18) establishes a connection between the ground potential of the circuit device (2) and a ground electrode (16) of the spark plug (10).

An apparatus characterized in that the circuit device (2) comprises a circuit housing (3) which electromagnetically shields the circuit (4), wherein the shielding element (18) is connected to a ground potential of the circuit housing (3) and/or to a ground potential of the circuit (4).

A transmission element (6) for transmitting an ignition signal from an ignition system to a spark plug (10), having a contact element (7), characterized in that the contact element (7) is provided with an electrically conductive coating (20) at least along a section of its longitudinal axis (A), wherein the impedance of the coating (20) is lower than the impedance of the contact element (7), and wherein the contact element (7) is at least in certain sections embodied as a contact spring and/or as a spring arm and/or made from a resilient material.

A transmission element (6) characterized in that the lower impedance of the coating (20) compared to the contact element (7) results from the fact that the magnetic permeability of the coating (20) is lower than the magnetic permeability of the contact element (7) and/or the electrical conductivity of the coating (20) is higher than the electrical conductivity of the contact element (7).

A transmission element (6) characterized in that the magnetic permeability of the coating (20) is lower than the magnetic permeability of steel and/or in that the electrical conductivity of the coating (20) is higher than that of stainless steel, preferably higher than the electrical conductivity of iron.

A transmission element (6) characterized in that the coating (20) has several layers (21,22,23).

A transmission element (6) characterized in that the coating (20) is formed from metal, or at least one, two, three or more or all of the layers (21,22,23) of the coating is/are formed from metal or metals.

A transmission element (6) characterized in that the coating (20) or at least one, two, three or more or all of the layers (21,22,23) of the coating is/are formed from silver, copper, gold, tin, aluminium, tungsten, molybdenum, titanium, zirconium, niobium, tantalum, bismuth, palladium, lead, an alloy, mainly comprising one or more of these materials, or from a composite material composed of one of these materials.

A transmission element (6) characterized in that the contact element (7) is made of metal, preferably steel or stainless steel.

A transmission element (6) characterized in that the transmission element (6) has an insulation element (8) which surrounds the contact element (7) provided with the coating.

A transmission element (6) characterized in that the transmission element (6) has an electrically conductive shielding element (18) which surrounds the insulation element (8) on the outside at least along a section of its longitudinal axis (A).

An ignition device, with an ignition system (1) for generating an ignition signal, and with a transmission element (6) in order to transmit the ignition signal to a spark plug (10).

A circuit device (2) for superimposing a high-frequency signal on a high ignition voltage, and with a transmission element (6) as claimed in one of claims 15 to 23, in order to transmit the high ignition voltage on which the high-frequency signal is superimposed to the spark plug (10).

An apparatus for igniting a fuel mixture comprising: an ignition system (1) for generating a high ignition voltage; a circuit device (2), having a circuit (4) for superimposing a high-frequency signal on the high ignition voltage; a spark plug (10) arranged in an engine block (9); a transmission element (6) for transmitting the high ignition voltage on which the high-frequency signal is superimposed to the spark plug (10), and wherein the transmission element (6) has a contact element that has an electrically conductive coating (7), at least along a section of the contact element's longitudinal axis A, and the electrically conductive coating 20 has an impedance that is lower than an impedance of the contact element (7).

An apparatus wherein, magnetic permeability of the electrically conductive coating (20) is lower than magnetic permeability of the contact element (7).

An apparatus wherein the magnetic permeability of the electrically conductive coating (20) is lower than the magnetic permeability of steel.

An apparatus wherein the electrically conductive coating has an electrical conductivity of at least $1.4\times10^6$ Siemens per meter (S/m), and preferably at least of $10\times10^6$ Siemens per meter (S/m).

An apparatus wherein the electrically conductive coating (20) has several layers (21,22,23).

An apparatus wherein the electrically conductive coating is at least partially formed from metal.

An apparatus wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy, mainly comprising one or more of these materials, or from a composite material composed of one of these materials.

An apparatus wherein the electrically conductive coating (20) has a thickness of between approximately 1.0 μm to 30 μm, and preferably between approximately 2.0 μm to 25 μm.

An apparatus wherein the contact element (7) is made of metal.

An apparatus wherein the contact element 7 is a spring.

An apparatus wherein the contact element is formed, at least partially, of a resilient material.

An apparatus further comprising: an insulation element (8) which surrounds the contact element (7).

An apparatus further comprising: an electrically conductive shielding element (18) which surrounds the contact element (7) in an electromagnetically shielding manner at least along a section of the longitudinal axis (A), and wherein the electrically conductive shielding element (18) is electrically conductively connected to a ground potential of the circuit device (2) and the electrically conductive shielding element (18) establishes a connection between a ground potential of the circuit device (2) and a ground electrode (16) of the spark plug (10).

An apparatus further comprising: a circuit housing (3) which electromagnetically shields the circuit (4), and wherein the electrically conductive shielding element (18) is connected to at least one of a ground potential of the circuit housing (3) and a ground potential of the circuit (4).

A transmission element (6) for transmitting an ignition signal from an ignition system to a spark plug, the transmission element comprising: a contact element 7 defining a longitudinal axis and having an electrically conductive coating (20) at least along a section of the longitudinal axis (A), and wherein the electrically conductive coating has an impedance, and the impedance of the electrically conductive coating (20) is lower than an impedance of the contact element (7).

A transmission element (6) wherein magnetic permeability of the electrically conductive coating (20) is lower than magnetic permeability of the contact element (7).

A transmission element (6) wherein the magnetic permeability of the electrically conductive coating (20) is lower than the magnetic permeability of steel.

A transmission element (6) wherein the electrically conductive coating (20) has several layers (21,22,23).

A transmission element (6) wherein the electrically conductive coating (20) is at least partially formed from metal.

A transmission element (6) wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy.

A transmission element (6) wherein the contact element (7) is made of metal, and preferably steel or stainless steel.

A transmission element (6) and further comprising: an insulation element (8) which surrounds the contact element (7) having the electrically conductive coating.

A transmission element (6) and further comprising: an electrically conductive shielding element (18) which surrounds the insulation element (8) at least along a section of a longitudinal axis (A) of the insulation element, and on an outside of the insulation element.

An ignition device comprising: an ignition system 1 for generating an ignition signal; and a transmission element 6 having, a contact element 7 that is formed of metal and defines a longitudinal axis A and has an electrically conductive coating 20 at least along a section of the longitudinal axis A, and wherein the electrically conductive coating 20 has an impedance that is lower than an impedance of the contact element 7, and wherein the contact element 7 is at least partially, at least one of a contact spring and a spring arm, and is at least partially formed of resilient material, and wherein electrical conductivity of the electrically conductive coating 20 is higher than electrical conductivity of the contact element 7, and wherein the electrically conductive coating 20 has several layers, and wherein the electrically conductive coating 20 is at least partially formed of a metal selected from the group consisting of silver, copper, gold, tin, aluminium, tungsten, molybdenum, titanium, zirconium, niobium, tantalum, bismuth, palladium, lead, and an alloy, comprising at least one of these materials, and an insulation element 8 which surrounds the contact element 7 that has the electrically conductive coating 20, and an electrically conductive shielding element 18 surrounds the insulation element 8 at least along a section of a longitudinal axis A of the insulation element 8, and on an outside of the insulation element 8; and the transmission element 6 transmits the ignition signal to a spark plug 10.

A circuit device 2 for superimposing a high-frequency signal on a high ignition voltage, comprising: a transmission element 6 having, a contact element 7 that is formed of metal and defines a longitudinal axis A and has an electrically conductive coating 20 at least along a section of the longitudinal axis A, and wherein the electrically conductive coating 20 has an impedance that is lower than an impedance of the contact element 7, and wherein the contact element 7 is at least partially, at least one of a contact spring and a spring arm, and is at least partially formed of resilient material, and wherein electrical conductivity of the electrically conductive coating 20 is higher than electrical conductivity of the contact element, 7 and wherein the electrically conductive coating 20 has several layers, and wherein the electrically conductive coating 20 is at least partially formed of a metal selected from the group consisting of silver, copper, gold, tin, aluminium, tungsten, molybdenum, titanium, zirconium, niobium, tantalum, bismuth, palladium, lead, and an alloy, comprising at least one of these materials, and an insulation element 8 which surrounds the contact element 7 that has the electrically conductive coating 20, and an electrically conductive shielding element 18 surrounds the insulation element 8 at least along a section of a longitudinal axis A of the insulation element 8, and on an outside of the insulation element 8; and the transmission element 6 transmits the high ignition voltage, on which the high-frequency signal is superimposed, to a spark plug 10.

An apparatus wherein, electrical conductivity of the electrically conductive coating 20 is higher than electrical conductivity of the contact element 7.

An apparatus wherein electrical conductivity of the electrically conductive coating 20 is higher than electrical conductivity of at least one of stainless steel and iron.

An apparatus wherein the electrically conductive coating 20 has a thickness of between approximately 3.0 μm to 25 μm and preferably a thickness between approximately 4.0 μm to 25 μm.

An apparatus wherein the contact element 7 is formed, at least partially, as a spring arm.

A transmission element 6 wherein the contact element 7 is at least partially at least one of a contact spring and a spring arm.

A transmission element 6 wherein the contact element 7 is made of a resilient material.

A transmission element 6 wherein electrical conductivity of the electrically conductive coating 20 is higher than electrical conductivity of the contact element 7.

A transmission element 6 wherein electrical conductivity of the electrically conductive coating 20 is higher than electrical conductivity of at least one of stainless steel and iron.

An apparatus wherein the magnetic permeability of the electrically conductive coating 20 is lower than the magnetic permeability of steel; and the electrical conductivity of the electrically conductive coating 20 is higher than the electrical conductivity of stainless steel.

An apparatus wherein the electrically conductive coating 20 is formed from material which has a lower magnetic permeability than the material from which the contact element 7 is made and which has a higher electrical conductivity than the material from which the contact element 7 is made.

An apparatus wherein the first layer is an adhesive layer of copper layer; and the second layer is a diffusion layer of nickel; and the third layer is a corrosion protection layer of gold or silver or tin.

An apparatus wherein the electrically conductive coating 20 has both a magnetic permeability that is lower than a magnetic permeability of the contact element 7 and the electrically conductive coating 20 has an electrical conductivity that is higher than an electrical conductivity of the contact element 7 which causes the electrically conducive coating 20 to have a lower impedance than the contact element 7.

We claim:

1. An apparatus for igniting a fuel mixture comprising:

an ignition system for generating a high ignition voltage;

a circuit device having a circuit for superimposing a high-frequency signal on the high ignition voltage;

a spark plug arranged in an engine block;

a transmission element for transmitting the high ignition voltage on which the high-frequency signal is superimposed to the spark plug and wherein the transmission element has a contact element that has an electrically conductive coating, at least along a section of the contact element's longitudinal axis, and the electrically conductive coating has an impedance that is lower than an impedance of the contact element.

2. The apparatus as claimed in claim 1 and wherein, magnetic permeability of the electrically conductive coating is lower than magnetic permeability of the contact element.

3. The apparatus as claimed in claim 2 and wherein the magnetic permeability of the electrically conductive coating is lower than the magnetic permeability of steel.

4. The apparatus as claimed in claim 2 and wherein the magnetic permeability of the electrically conductive coating is lower than the magnetic permeability of steel; and the electrical conductivity of the electrically conductive coating is higher than the electrical conductivity of stainless steel.

5. The Apparatus of claim 2 and wherein the electrically conductive coating has both a magnetic permeability that is lower than a magnetic permeability of the contact element and the electrically conductive coating has an electrical conductivity that is higher than an electrical conductivity of the contact element which causes the electrically conductive coating to have a lower impedance than the contact element.

6. The apparatus as claimed in claim 1 and wherein the electrically conductive coating has an electrical conductivity of at least $1.4\times10^8$ Siemens per meter, and preferably at least of $10\times10^6$ Siemens per meter.

7. The apparatus as claimed in claim 1 and wherein the electrically conductive coating has several layers.

8. The apparatus as claimed in claim 7 and wherein the first layer is an adhesive layer of copper; and the second layer is a diffusion layer of nickel; and the third layer is a corrosion protection layer of gold or silver or tin.

9. The apparatus as claimed in claim 1 and wherein the electrically conductive coating is at least partially formed from metal.

10. The apparatus as claimed in claim 1 and wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy.

11. The apparatus as claimed in claim 1 and wherein the electrically conductive coating has a thickness of between approximately 1.0 μm to 30 μm, and preferably between approximately 2.0 μm to 25 μm.

12. The apparatus as claimed in claim 1 and wherein the contact element is made of metal.

13. The apparatus as claimed in claim 1 and wherein the contact element is a spring.

14. The apparatus as claimed in claim 1 and wherein the contact element is formed, at least partially, of a resilient material.

15. The apparatus as claimed in claim 1 and further comprising:

an insulation element which surrounds the contact element.

16. The apparatus as claimed in claim 1 and further comprising:

an electrically conductive shielding element which surrounds the contact element in an electromagnetically shielding manner at least along a section of the longitudinal axis, and wherein the electrically conductive shielding element is electrically conductively connected to a ground potential of the circuit device and the electrically conductive shielding element establishes a connection between a ground potential of the circuit device and a ground electrode of the spark plug.

17. The apparatus as claimed in claim 16, and further comprising:

a circuit housing which electromagnetically shields the circuit wherein the electrically conductive shielding element is connected to at least one of a ground potential of the circuit housing and a ground potential of the circuit.

18. The apparatus as claimed in claim 1 and wherein, electrical conductivity of the electrically conductive coating is higher than electrical conductivity of the contact element.

19. The apparatus as claimed in claim 1 and wherein electrical conductivity of the electrically conductive coating is higher than electrical conductivity of at least one of stainless steel and iron.

20. The apparatus as claimed in claim 1 and wherein the electrically conductive coating has a thickness of between approximately 3.0 μm to 25 μm and preferably a thickness between approximately 4.0 μm to 25 μm.

21. The apparatus as claimed in claim 1 and wherein the contact element is formed, at least partially, as a spring arm.

22. The apparatus as claimed in claim 1 and wherein the electrically conductive coating is formed from material which has a lower magnetic permeability than the material from which the contact element is made and which has a higher electrical conductivity than the material from which the contact element is made.

23. A transmission element for transmitting an ignition signal from an ignition system to a spark plug, the transmission element comprising:

a contact element defining a longitudinal axis and having an electrically conductive coating at least along a section of the longitudinal axis, and wherein the electrically conductive coating has an impedance, and the impedance of the electrically conductive coating is lower than an impedance of the contact element.

24. The transmission element as claimed in claim 23, and wherein magnetic permeability of the electrically conductive coating is lower than magnetic permeability of the contact element.

25. The transmission element as claimed in claim 24, and wherein the magnetic permeability of the electrically conductive coating is lower than the magnetic permeability of steel.

26. The transmission element as claimed in claim 23 and wherein the electrically conductive coating has several layers.

27. The transmission element as claimed in claim 23 and wherein the electrically conductive coating is at least partially formed from metal.

28. The transmission element as claimed in claim 23 and wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy.

29. The transmission element as claimed in claim 23 and wherein the contact element is made of metal.

30. The transmission element as claimed in claim 23 and further comprising:

an insulation element which surrounds the contact element having the electrically conductive coating.

31. The transmission element as claimed in claim 30, and further comprising:

an electrically conductive shielding element which surrounds the insulation element at least along a section of a longitudinal axis of the insulation element, and on an outside of the insulation element.

32. The transmission element of claim 23 and wherein the contact element is at least partially at least one of a contact spring and a spring arm.

33. The transmission element of claim 23 and wherein the contact element is made of a resilient material.

34. The transmission element as claimed in claim 23, and wherein electrical conductivity of the electrically conductive coating is higher than electrical conductivity of the contact element.

35. The transmission element as claimed in claim 24, and wherein electrical conductivity of the electrically conductive coating is higher than electrical conductivity of at least one of stainless steel and iron.

36. An ignition device comprising:

an ignition system for generating an ignition signal; and a transmission element having, a contact element that is formed of metal and defines a longitudinal axis and has an electrically conductive coating at least along a section of the longitudinal axis, and wherein the electrically conductive coating has an impedance that is lower than an impedance of the contact element, and wherein the contact element is at least partially, at least one of a contact spring and a spring arm, and is at least partially formed of resilient material, and wherein electrical conductivity of the electrically conductive coating is higher than electrical conductivity of the contact element, and wherein the electrically conductive coating has several layers, and wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy, comprising at least one of these materials, and an insulation element which surrounds the contact element that has the electrically conductive coating, and an electrically conductive shielding element surrounds the insulation element at least along a section of a longitudinal axis of the insulation element, and on an outside of the insulation element; and the transmission element transmits the ignition signal to a spark plug.

37. A circuit device for superimposing a high-frequency signal on a high ignition voltage, comprising:

a transmission element having, a contact element that is formed of metal and defines a longitudinal axis and has an electrically conductive coating at least along a section of the longitudinal axis, and wherein the electrically conductive coating has an impedance that is lower than an impedance of the contact element, and wherein the contact element is at least partially, at least one of a contact spring and a spring arm, and is at least partially formed of resilient material, and wherein electrical conductivity of the electrically conductive coating is higher than electrical conductivity of the contact element, and wherein the electrically conductive coating has several layers, and wherein the electrically conductive coating is at least partially formed of a metal selected from the group consisting of silver, copper, gold, tin, aluminium, tungsten, molybdenum, titanium, zirconium, niobium, tantalum, bismuth, palladium, lead, and an alloy, comprising at least one of these materials, and an insulation element which surrounds the contact element that has the electrically conductive coating, and an electrically conductive shielding element surrounds the insulation element at least along a section of a longitudinal axis of the insulation element, and on an outside of the insulation element; and the transmission element transmits the high ignition voltage, on which the high-frequency signal is superimposed, to a spark plug.

* * * * *